US005388182A

United States Patent [19]

Benedetto et al.

[11] Patent Number: 5,388,182

[45] Date of Patent: Feb. 7, 1995

[54] NONLINEAR METHOD AND APPARATUS FOR CODING AND DECODING ACOUSTIC SIGNALS WITH DATA COMPRESSION AND NOISE SUPPRESSION USING COCHLEAR FILTERS, WAVELET ANALYSIS, AND IRREGULAR SAMPLING RECONSTRUCTION

[75] Inventors: John J. Benedetto, Hyattsville; Anthony Teolis, Upper Marlboro, both of Md.

[73] Assignee: Prometheus, Inc., Sharon, Mass.

[21] Appl. No.: 17,192

[22] Filed: Feb. 16, 1993

[51] Int. Cl.[6] ..... G10L 7/02

[52] U.S. Cl. ..... 395/2.14; 395/2.12; 395/2.2

[58] Field of Search ..... 381/29–37, 381/40; 395/2, 2.14, 2.12, 2.2, 2.13, 2.15

[56] References Cited

PUBLICATIONS

Hirahara et al., "A Computational Cochlear Nonlinear Preprocessing Model With Adaptive Q Circuits", Proceedings of ICASSP, 23–26 May 1989.

Avellana et al., "VLSI Implementation of a Cochlear Model", Proceedings of Euro ASIC 27–31 May 1991, IEEE, pp. 45–48.

Friedman, "Implementation of A Nonlinear Wave-Digital-Filter Cochlear Model", ICASSP 3–6 Apr. 1990, IEEE, pp. 397–400 vol. 1.

X. Yang, K. Wang, and S. Shamma, "Auditory Representations of Acoustic Signals," *IEEE Trans. on Information Theory*, 38(2):824–839, Mar. 1992.

S. A. Shamma, R. Chadwick, J. Wilber, J. Rinzel, and K. Moorish, "A Biophysical Model of Cochlear Processing: Intensity Dependence of Pure Tone Responses," *J. Acoust. Soc. Am.* 80(1986), 133–145.

Charles K. Chui, *An Introduction to Wavelets*. Academic Press, 1992.

John J. Benedetto, "Irregular Sampling and Frames," in C. Chui (editor), *Wavelets: A Tutorial in Theory and Applications*, Academic Press, 1992.

John J. Benedetto and William Heller, "Irregular Sampling and the Theory of Frames," *Note Math.*, 1990.

Alan V. Oppenheim and Ronald W. Schafer, *Digital Signal Processing* (Prentice Hall, Englewood Hills, N.J. 1975), Ch. 7.

R. R. Pfeiffer and D. O. Kim, "Cochlear Nerve Fiber Responses: Distribution Along the Cochlear Partition," *J. Acoust. Soc. Am.*, 58:867–869, 1975.

I. Morishita and A. Yajima, "Analysis and Simulation of Networks of Mutually Inhibiting Neurons," *Kybernetik*, 11:154–165, 1972.

S. Mallat and S. Zhong, "Wavelet Transform Maxima and Multiscale Edges," in M. B. Ruskai, et al. (editors), *Wavelets and Their Applications* (Jones and Bartlett, Boston, 1992).

*Primary Examiner*—David D. Knepper

*Attorney, Agent, or Firm*—Frederick C. Williams

[57] ABSTRACT

WAM TM is a new method of digitally coding and decoding acoustic signals for data compression and noise reduction. The method comprises constructing a filter bank using wavelet transforms of a basic filter impulse function to represent the response of the mammalian cochlea. Data compression is obtained by truncation of a discrete representation. Reconstruction relies on the theory of frames and produces a reconstruction method and apparatus based on irregular sampling methods which produces good quality results in a very few stages. Actual reconstructions show very good data compression and noise reduction performance.

8 Claims, 14 Drawing Sheets

NONLINEAR METHOD AND APPARATUS FOR CODING AND DECODING ACOUSTIC SIGNALS WITH DATA COMPRESSION AND NOISE SUPPRESSION USING COCHLEAR FILTERS, WAVELET ANALYSIS, AND IRREGULAR SAMPLING RECONSTRUCTION

CROSS REFERENCE TO MICROFICHE APPENDIX

This application includes a computer program listing in the form of Microfiche Appendix A which has been filed in this Application as 144 frames (exclusive of target and title frames) distributed over 2 sheets of microfiche in accordance with 37 C.F.R. §1.96. The disclosure of Appendix A is incorporated by reference into this specification. It should be noted that the disclosed source code in Appendix A and the object code which results from compilation of the source code and any other expression appearing in the listings or derived therefrom are subject to copyright protection. The copyright owner has no objection to the facsimile reproduction by anyone of the patent document (or the patent disclosure as it appears in the files or records of the U.S. Patent and Trademark Office) for the sole purpose of studying the disclosure to understand the invention, but otherwise reserves all other rights to the disclosed computer listing including the right to reproduce said computer program in machine executable form and/or to transform it into machine-executable code.

BACKGROUND OF THE INVENTION

Acoustic signal coding and decoding, especially for data compression and noise reduction, and particularly with respect to the electronic transmission of speech signals, have been of much interest to inventors. Some recent inventions encode frequency and phase information as a function of time. An example is McAuley, et al., U.S. Pat. No. 4,885,790, issued Dec. 5, 1989. In general such systems encode too much information for optimal data compression.

Some innovators have endeavored to use knowledge of physiological processes as a guide to design of acoustic devices. Modeling the vocal tract has produced approaches, for example, a type of system known as CELP. In particular, Bertrand, U.S. Pat. No. 5,150,410, issued Sep. 22, 1992, discloses a voice coding system for encryption of remote conference voice signals which uses the code excited linear predictive speech processing algorithm (CELP) as the basis for analyzing and then reconstructing voice signals. Linear predictive methods prior to CELP often produced reconstructed speech which sounded unnatural or disturbed. See Atal et al., U.S. Pat. No. Re 32,580, reissued Jan. 19, 1988. On the other hand, personal observation suggests that CELP-10, for example, does not always deal well with signals superimposed with high levels of noise. Moreover, a major drawback of the CELP approach is that it requires a burdensome degree of "bookkeeping" calculations, even with recent progress due to Baras and Kao. In addition, since CELP is tied to the vocal tract conceptually, it has severe limitations for processing signals other than speech.

Recently the cochlear system has also drawn attention as a possible guide for new methods of handling audible signals. For example, Van Compernolle, U.S. Pat. No. 4,648,403, issued Mar. 10, 1987, discloses a system for stimulating the cochlear nerve endings in a hearing prosthesis using a deconvolution technique. Seligman, et al., U.S. Pat. No. 5,095,904, issued Mar. 17, 1992, discloses a prosthetic method of stimulating the auditory nerve fiber in profoundly deaf persons with several different pulsate signals representing energy in different acoustic energy bands to convey speech information. Allen et al., U.S. Pat. No. 4,905,285, issued Feb. 27, 1990, discloses signal processing based on analysis of auditory neural firing patterns. These inventions, however, do not exploit biophysical modeling of auditory physiological processes as a tool in signal processing.

Understanding and modeling of the processing of audible signals in the human, and more generally in the mammalian, auditory system have progressed significantly in the last decade. Application of this new knowledge to design of signal processing systems for audible signals, however, is in its infancy.

In the human auditory system an incoming acoustic signal produces a pattern of transverse displacements on the basilar membrane, which responds to frequencies between about 200 and about 20,000 Hz. Displacements for high frequencies occur at the basal end of the membrane and those for low frequencies occur at the wider apical end. In general an incoming signal causes a traveling wave of transverse displacements on the basilar membrane. The position of a particular displacement along the centerline of the membrane is functionally equivalent to a parameter called "scale" which we use in this invention.

Recent research especially Yang, Wang, Shamma, has shown that the cochlear response to these traveling waves can be modeled effectively as the response of a parallel bank of linear time-invariant acoustic filters. Generally the filters must have an amplitude of appropriate shape in the frequency domain, namely peaked asymmetrically around a characteristic frequency with band width increasing with frequency. E.g., Yang, Wang, Shamma; S. A. Shamma, R. Chadwick, J. Wilbur, J. Rinzel, and K. Moorish, "A Biophysical Model of Cochlear Processing: Intensity Dependence of Pure Tone Responses," J. Acoustical Society of America, 80:133–145 (1986). Fundamental considerations also suggest that the filters be causal, that is, not incorporate future information into present signals or predict future signals from past information. As we elaborate in the discussion of our invention, causality imposes constraints on the phase of the filters.

If the individual filter transform functions have an appropriate shape relationship, the filters will be related by a simple wavelet dilation of a basic filter impulse function which is the basis of a wavelet representation Charles K. Chui, An Introduction To Wavelets. (Academic Press 1992) [cited below as "Chui"].

$$D_S g(t) = s^{178} g(st) \tag{1}$$

where s is the scale parameter and g is the impulse response whose Fourier transform g is the filter transfer function.

Shamma and coworkers in Yang, Wang, Shamma showed that the cochlear filter bank can be approximately modeled as a wavelet transform where the scale parameter is in one to one correspondence with location along the basilar membrane. Since we know that the number of nerve channels in the auditory system is finite, the number of equivalent cochlear filters in the filter bank is also finite, with the set of characteristic scales being denoted as the finite set $\{S_m\}$, where the notation {} denotes a "set" of numbers.

The filter characteristic scales are typically exponentially related to a tuning parameter $a_o$, that is, $S_m=(a_o)^m$.

The precise shape of the amplitude of the filter transfer function is critical for the effectiveness of auditory modeling. Investigation of the mammalian cochlea teaches that equivalent cochlear filters must have sharply asymmetrical filter transform function amplitude in the frequency domain, a shape often referred to as a "shark-fin" shape. R. R. Pfeiffer and D. O. Kim, "Cochlear Nerve Fiber Responses: Distribution Along the Cochlear Partition," J. Acoustical Society of America, 58:867–869 (1975). In particular, the rate of decay (roll-off) of the filter transfer function with respect to distance from its characteristic frequency must be very much higher on the high frequency side than on the low frequency side. The high frequency edges of the cochlear filters act as abrupt "scale delimiters." A pure sinusoidal tone stimulus creates a traveling wave response in the basilar membrane which dies out rapidly above a maximum scale. The filter bank equivalent is that the pure tone produces a response of each filter up to the appropriate scale and an abruptly diminishing response beyond that scale.

In a wavelet representation we identify the traveling wave displacements W on the basilar membrane due to an incoming acoustic signal f(t) with the wavelet transform $W_g f(t,S_m)\equiv f(t)*D_{S_m}g(t)$, where g is the basic impulse, response (g, the Fourier transform of the impluse response, is referred to as the filter transfer function),"*" is convolution with respect to time, the $s_m$'s are the finite number of scales characteristic of the specific filter bank, and $\{D_{s_m}g\}$ is the finite set of cochlear filter bank impulse responses. The entire filter bank produces a wavelet transform of the incoming signal f.

The auditory nervous system does not receive the physiological equivalent of a wavelet transform directly, but rather transmits a substantially modified version of such a transform. It is known that in the next step of the auditory process, the equivalent of the output of each cochlear filter is transmitted by the velocity coupling between the cochlear membrane and the cilia of the hair cell transducers that initiate the electrical nervous activity by a shearing action on the tectorial membrane. Through this process the mechanical motion of the basilar membrane is converted to a receptor potential in the inner hair cells. A time derivative of the wavelet transform, $$\frac{\partial W_g(t,s)}{\partial t},$$

models the velocity coupling well. (Ref. 1.) The extrema of the wavelet transform W occur at the zero-crossings of the new function $$\frac{\partial W_g(s,t)}{\partial t},$$

In the next step in the auditory process, the threshold and saturation that occur in the hair cell channels and the leakage of electrical current through the membranes of these cells modify the output signal. It is also known to model these two phenomena by applying an instantaneous sigmoidal non-linearity, which can be of the form $$R_T(y) = \frac{e^{Ty}}{1 + e^{Ty}},$$

to the coupled signal followed by a low-pass filter with impulse response h. At this point, the model of the cochlear output $C_{h,R}(t,s)$ can be written as $$C_{h,R}(t,s) = R_T\left(\frac{\partial W_g(t,s)}{\partial t}\right)*h(t) \tag{2}$$

where "*" is again convolution with respect to time.

The human auditory nerve patterns produced by the cochlear output are then processed by the brain in ways that are incompletely understood. One processing model which has been studied with a view toward extracting the spectral pattern of the acoustic stimulus is the lateral inhibitory network (LIN). I. Morishita and A. Yajima, "Analysis and Simulation of Networks of Mutually Inhibiting Neurons," Kybernetik, 11:154–165 (1972). Scientifically LIN reasonably reflects proximate frequency channel behavior and is analytically tractable. The simplest model of LIN is as a partial derivative of the primitive cochlear output with respect to scale:

$$\frac{\partial C(t,s)}{\partial s} = \left[R_T'\left(\frac{\partial W_g(t,s)}{\partial t}\right)\cdot\frac{\partial}{\partial s}\ \frac{\partial W_g(t,s)}{\partial t}\right]*h(t) \tag{3}$$

Prior work involving creation of such representations of acoustic signals and reconstruction of the original signal from the representation, such as that found in Ref. 1, achieved useful and interesting results. However, this work, e.g., Ref. 1, used generic methods, such as reconstruction by the method of alternating projections, a staple in many engineering applications, e.g., S. Mallat and S. Zhong, "Wavelet Transform Maxima and Multiscale Edges," in M. B. Ruskai, et al. (editors), Wavelets and Their Applications (Jones and Bartlett, Boston, 1992) not specifically tailored for acoustic processing. It also did not encompass data compression other than that inherent in the wavelet representation itself and did not produce any known noise reduction results.

The current invention is directed to an improvement to this general approach which will enable the method and apparatus based on it to be used specifically for data compression and noise reduction in real time and near real time acoustic applications, for example, voice telephony. Specifically, this invention is a method of and apparatus for encoding audible signals with wavelet transforms in such a manner that an irregular sampling method of reconstruction back to the original signal is known to approximate the original signal with accuracy increasing exponentially with each iteration of the method. Empirically the method converges so rapidly that for many purposes the first reconstruction with no iterations is adequate. This invention is further directed to constructing an irregular sampling method of decoding accurately a wavelet transform representation using a substantially reduced sample of a full wavelet representation obtained by truncation, thereby enabling significant data compression. The invention is further directed to selection of partial representations for transmission and reproduction of signals representing audible sounds, especially speech, which, while retaining significant data compression, achieve a high degree of noise reduction which can be optimized by sacrificing some compression. Finally, the invention is directed to a method of reconstruction of wavelet representations of acoustic signals based on the theory of irregular sampling such that the method produces high quality reconstructions of acoustic signals with a very small number of iterations of the method.

SUMMARY OF THE INVENTION

This invention is a wavelet auditory model (WAM TM) acoustic signal encoding and decoding system. The invention is based on a wavelet transform time and scale representation of acoustic signals following a model of the processing of audible signals in the mammalian auditory system outlined in X. Yang, K. Wang, and S. Shamma, "Auditory Representations of Acoustic Signal, "IEEE Transactions on Information Theory 38 (2):824–839 (March 1992) [cited below as "*Yang, Wang, Shamma.*"]. We use a mammalian cochlear filter bank comprising a finite number of filters in which the filters accurately model the amplitude of the frequency response of the basilar membrane using a "shark-fin" shaped filter amplitude. The precise filter shape is constructed so that the phase of the filter satisfies the Hilbert Transform relation which assures causality of the filter. We incorporate the basic filter design in a wavelet transform which models the scale dilation on the basilar membrane of the mammalian ear. Scaling according to the wavelet dilation function for a finite number of scales produces a finite filter bank. The wavelet auditory model processes an acoustic signal through the model to obtain a critical set of points irregularly spaced in a time-scale plane, each of which has associated a magnitude which we call the "wavelet auditory model coefficient." The planar array of wavelet auditory model coefficients is irregularly spaced, an appropriate configuration for our method of reconstruction.

For digital transmission or storage, we quantize the wavelet auditory model coefficients with a number of bits appropriate for the transmission or storage medium. For signal compression, we compress the signal by first fixing a bit rate determined from the transmission channel data rate or the amount of storage available and a bit allocation. The method then determines an allowable coefficient rate for these constraints. This rate in turn fixes a threshold value for the wavelet auditory model coefficients. The next step in the process is discarding the wavelet auditory model points and coefficients for which the coefficients are below the threshold, producing a truncated set of wavelet auditory model points and coefficients. The quantized and truncated set of time-scale points and associated wavelet auditory model coefficients is a substantially compressed representation of the signal. Since the full representation is overcomplete in a mathematical sense, the truncated set of coefficients will be complete or nearly so (depending on the degree of truncation) and will, if the truncation is not too severe, latently contain the entire original signal. The truncated representation is transmitted or stored for later reconstruction.

We then reconstruct successive approximations to the original signal using only the truncated set of wavelet auditory model coefficients determined by the imposed coefficient rate. For this purpose we use a rapidly convergent iterative algorithm derived from irregular sampling theory. In practice the first iteration is sufficient for some applications. For others, a small number of iterations will improve signal quality sufficiently. The wavelet auditory model has inherent noise suppression properties which can be optimized by giving up some signal compression. In particular, we have demonstrated the wavelet auditory model as a speech processing tool, but have shown that it works well for other audible signals as well.

DETAILED DESCRIPTION OF THE INVENTION

Figure 1:
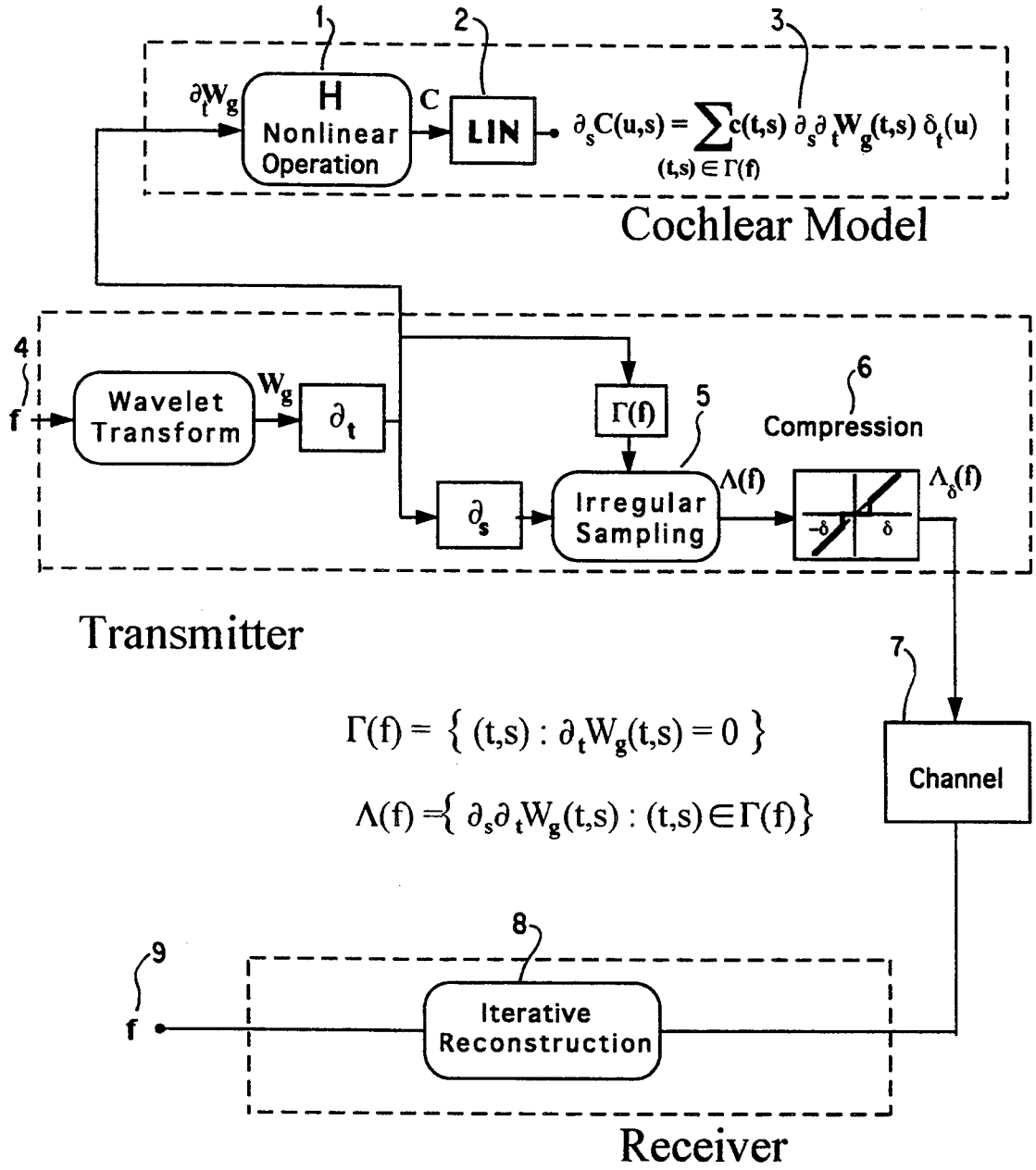
FIG. 1 is a schematic diagram of the wavelet auditory model method of signal coding and reconstruction.

The current invention makes use of the previously described new knowledge of cochlear signal processing to create a system for encoding, compressing, and decoding, that is, reconstructing, audible signals, especially those representing speech, to achieve significant signal compression and suppression of noise and background. This system is optimal in the sense that the encoding method is specifically designed for a reconstruction method based on irregular sampling theory which is known to converge rapidly when certain empirically verified conditions are met.

The current invention uses a particular form of the shark-fin shaped cochlear filter transfer function which has properties necessary for causality. Causality is a fundamental consideration, but in practice causality also proves to be necessary empirically for our method of reconstruction of the signal to work. We further make simplifying approximations which make the modeled cochlear output more amenable to reconstruction by our method.

Following Yang, Wang, Shamma, we make the simplification that $T \rightarrow \infty$ in the sigmoidal function modeling the threshold and saturation effects, yielding in the limit the Heaviside function H for the non-linear function $R_T(y)$. (See p. 8, line 10, supra.) In the limit the derivative of $R_T$ in Equation 3 picks out the values of the mixed partial derivative of the wavelet transform at the zeros of the time partial derivative of the wavelet transform. This nonlinear operation creates an irregularly spaced pattern in the time-scale plane. This pattern is the inspiration of the critical component of this invention, namely the recognition that irregular sampling theory, John J. Benedetto, "Irregular Sampling and Frames," in C. Chui (editor), *Wavelets: A Tutorial in Theory and Applications* (Academic Press, 1992) [cited below as "*Benedetto*"], and John J. Benedetto and William Heller, "Irregular Sampling and the Theory of Frames," *Note Math.*, 1990 [cited below as "*Benedetto and Heller*"], enables accurate reconstruction of the incoming signal with substantially less than all of the information in the full wavelet representation.

For simplicity, we ignore the time averaging effects implicit in the impulse function h by taking it to be the delta function. This simplifying assumption is convenient but not necessary and may be relaxed in further improvements in this invention.

The model produces the result:

$$\frac{\partial C}{\partial s} \approx \Sigma \frac{1}{\left| \frac{\partial^2 W_g(t,s)}{\partial t^2} \right|} \cdot \frac{\partial}{\partial s} \frac{\partial W_g(t,s)}{\partial t} \cdot \delta_t \tag{4}$$

where the summation is taken over the extrema of the wavelet transform, and inherently countable set due to the analyticity of the functions involved.

Thus in this model, the data processed by the "brain" depends only on the values of the mixed partial derivative, $$\frac{\partial}{\partial s} \frac{\partial W_g(t,s)}{\partial t},$$

divided by the curvature of the wavelet transform, $$\left| \frac{\partial^2 W_g(t,s)}{\partial t^2} \right|,$$

evaluated at the set of points $\{t_{m,n}\}$ at which $$\frac{\partial W}{\partial t}$$

is zero for a given $s_m$. In the present implementation, we make the further simplifying assumption that the curvature does not vary significantly and therefore ignore the denominators. Thus the WAM TM coefficients in this embodiment are simply the set of mixed partial derivatives $$\left\{ \frac{\partial}{\partial s} \frac{\partial W_g(t,s)}{\partial t} \right\}.$$

We expect that utilizing the curvature denominators in future embodiments will result in further improvement in the performance of this invention.

Under suitable physically realistic conditions such as bandwidth limitation and finite energy in the input signal, a complete representation of the incoming signal comprises the wavelet coefficients evaluated at the countable set of points $\{(t_{m,n}, s_m)\}$ at which the wavelet transform is a maximum as a function of time, that is, at which the partial derivative of the wavelet transform with respect to time, $$\frac{\partial W_g(t,s)}{\partial t}$$

vanishes.

We label the values of the simplified coefficients $$\frac{\partial}{\partial s} \frac{\partial W_g(t_{m,n}, s_m)}{\partial t}$$

as the wavelet auditory model coefficients in this embodiment.

Approximating the derivatives as finite differences between adjacent points at the countable set of points in the t,s plane $\Gamma_w(f) = \{(t_{mn}, s_m)\}$ and using the fact that the partial time derivative vanishes at $\{t_{m,n}, s_m\}$ leads to the following approximate formula for the WAM TM coefficients:

$$\Lambda_w(f) = \left\{ \frac{\frac{W_{\partial g}}{\partial t} f(t_{m,n}, s_{m-1})}{\sqrt{1 - a_0}} \right\} \tag{6}$$

evaluated at $(t,s) \in \{(t_{m,n}, s_{m-1})\}$ and $a_o$ is a parameter (see p. 6, line 18, supra), originally chosen such that $$\frac{1}{a_0} = 0.9445$$

for physiological reasons, which can be adjusted to optimize performance either for signal compression or noise reduction.

The most fundamental and novel feature of the current invention is the recognition that the wavelet auditory model representation in Equation 6 also represents an irregular sampling of the wavelet transform $$\frac{1}{\sqrt{1 - a_0}} \cdot W_{\frac{\partial g}{\partial t}}(t,s).$$

That property leads to a reconstruction method based on the theory of frames, related to wavelet theory (*Chui*) and depending fundamentally on the theory of irregular sampling as found in *Benedetto* and *Benedetto and Heller*. We assert that the wavelet auditory model representation completely describes and thus determines the signal. That assertion is intuitively plausible because the sampling density in the (m−1)-th channel is determined by the density of zero crossings in the m-th channel, likely to meet the Nyquist density required to preclude aliasing in the (m−1)-th channel.

The mathematical theory of frames, which is intimately tied to the theory of irregular sampling *Benedetto* and *Benedetto and Heller*, enables reconstruction.

Certain functions derived from the wavelet transform function, $$\Psi_{m,n} = \frac{1}{a_0 - 1} \tau_{tm,n} D_{sm-1} \left( \frac{\partial \tilde{g}}{\partial t} \right).$$

where $\tilde{g}(u) = \bar{g}(-u)$ and $\tau_u(g(t)) = g(t-u)$, are of a form required to produce a frame for a certain Hilbert space which is a subspace comprising functions sufficiently like the incoming signal. The wavelet auditory model coefficients are directly related to these functions by the relationship $$\frac{\partial}{\partial s} \frac{\partial W_g(t_{m,n}, s_m)}{\partial t} = (f, \Psi_{m,n}),$$

where $< >$ denotes inner product. In our invention, the particular functions are dependent on the points $\{t_{m,n}, S_{m-1}\}$ for the particular signal. Empirically these functions form at least a local mathematical frame for the relevant portion of the Hilbert space of finite energy signal functions containing the particular incoming signal. We have derived a condition for frame properties of the local representation, $$0 < A \leqq G(\gamma) \leqq B < \infty$$

where A and B are the frame bounds, with $$G(\gamma) = \sum_m |D_{s\bar{m}1-1} \left( \frac{\partial \tilde{g}}{\partial t} \right)^{\sim}|^2$$

in which . indicates Fourier transform of the preceding expression in parentheses, and in practice the method satisfies the frame condition for all cases we have examined.

Using the theory of frames and a theorem for irregular sampling cast in frame theory, we construct an algorithm for reconstruction of the signal f from the wavelet representation described above using the relationships $$f = \lim f_n \tag{7}$$

$$f_n = \gamma \sum_{k=0}^{n} L^* (I - \lambda LL^*)^k (L \cdot f)$$

Lambda must be chosen properly for convergence. The theory of frames sets a precise condition, $$\lambda = \frac{2}{A + B},$$

where A and B are the frame bounds, but in practice we choose lambda empirically to be small enough to produce convergence in all instances in which we have applied wavelet auditory model.

In the embodiment, we use $$Lf = \left\{ \frac{W_{\frac{\partial g}{\partial t}} f(t_{m,n}, s_{m-1})}{\sqrt{1 - a_0}} \right\}$$

-continued $$L^*c = \Sigma \frac{C_{m,n}}{\sqrt{1 - a_0}} \tau_{tm,n} D_{sm-1} \frac{\partial g}{\partial t}.$$

with $\tilde{g}(u)$ as before (see p. 15, line 20), $c_{m,n} = <f, \Psi_{m,n}>$, and $c = \{c_{m,n}\}$. These relationships lead to the iterative algorithm for reconstruction as follows. Define $h_k \equiv \lambda L^* c_k$, $c_{k+1} = c_k - Lh_k = c_k - \lambda LL^* c_k$ and $f_{k+1} \equiv f_k + h_k$. In the first step we set $f_0 = 0$ and compute $h_0$, $c_0$, and $f_1 = f_0 + h_0$. At step $k+1$ we compute $h_k$ using $c_k$ from step n, compute $c_{k+1}$ using $h_k$ and $c_k$, and compute $f_{k+1} = f_k + h_k$. We define the wavelet auditory model (WAM TM) to be the entire process of coding, transmission or storage or other manipulation, and reconstruction using the iterative algorithm just set forth.

FIG. 1 is a schematic diagram of the wavelet auditory model process. With reference to FIG. 1, the nonlinear Heaviside operation 1 and the lateral inhibitory network 2 produce the basic wavelet cochlear model 3. Application of this model to the incoming function 4 produces the full wavelet representation which is equivalent to an irregular sampling set 5. Compression of the representation by truncation 6 produces a compressed set of values to be transmitted 7. At the receiving end, reconstruction by the method of this invention 8 produces a replica of the original signal 9.

PREFERRED EMBODIMENT

We have chosen a particular function for the wavelet transform filter function which has the correct shape but also results in causality of the filter. We have found in practice that causality is necessary to make the irregular sampling method of reconstruction work properly.

We define the amplitude of the basic filter transform function as follows:

$$A(\gamma) = \frac{A_\rho(O)}{d(\gamma*)} \cdot d(\gamma - \gamma*), \gamma \leqq 0$$

$$A(\gamma) = A_\rho(\gamma), 0 < \gamma < \Omega$$

$$A(\gamma) = \frac{A_\rho(\Omega)}{d(\gamma*)} \cdot d(\gamma - Q + \gamma*), \gamma \geqq \Omega$$

In this filter $$d(\gamma) = e^{-\frac{|\gamma|}{log2|\gamma|}}$$

and $A_\rho$ is the smoothed ramp function. This smoothed ramp function $A_\rho$ is a convolution of the straight line response function $R(\gamma) = K\gamma$, $0 \leqq \gamma \leqq \Omega$; $R(\gamma) = 0$ otherwise, with a narrow distribution, such as $$\rho(\gamma) = \frac{e^{\frac{-1}{\epsilon - |\gamma|^2}}}{\int e^{\frac{-1}{\epsilon - |\lambda|^2}} d\lambda}.$$

Thus the smoothed ramp function is $A_\rho(\gamma) = R^* \rho$, where "*" this time denotes convolution with respect to frequency.

To obtain the phase of a causal filter function we use the Hilbert Transform relationship from Chapter 7 of Alan V. Oppenheim and Ronald W. Schafer, *Digital Signal Processing*(Prentice Hall, 1975). The complex valued filter transform function is $\hat{g}=A(\gamma)e^{-iH(\log(A(\gamma)))}$ where the Hilbert Transform H satisfies the relationship $H(f)=(i\mathrm{sgn}(\gamma)\hat{f})\check{}$ in which the function $\mathrm{sgn}(\gamma)$ is $+1$ for $\gamma>0$ and $-1$ for $\gamma<0$ and $\check{}$ denotes inverse Fourier transform of the entire quantity in the preceding parentheses. Since by construction the logarithm of $A(\gamma)$ satisfies the hypotheses of the Paley-Wiener logarithmic integral theorem and the phase is chosen as shown above, $\hat{g}$ is a causal filter.

Signal Compression

In our method, it is the wavelet auditory model coefficients which are transmitted, stored, or otherwise manipulated, not the original analog signal or its digitized equivalent. For digital processing, we quantize the wavelet auditory model points and coefficients into a bit representation accommodating the accuracy required and the bit space available. According to the bit rate available for transmission or bit allocation available for storage, we truncate the wavelet auditory model points and coefficients and transmit or store only the truncated set. Signal compression is realized by thresholding the wavelet auditory model coefficients according to the parameters of the transmission channel available. We then reconstruct the incoming signal from this incomplete representation according to the algorithm set forth above.

For a given number of bits per coefficient b, we calculate a binary integer quantity proportional to the ratio of a particular wavelet auditory model coefficient to the maximum coefficient for the actual transmission process. Given a maximum bit rate of transmission available with a given transmission channel or bit allocation in a storage medium, we quantize the wavelet auditory model coefficients by scaling the largest wavelet auditory model coefficient to be the largest binary number available within the bit allocation and by equating the lesser binary coefficients to the largest binary integer less than or equal to the scaled value of the particular coefficient. We use uniform quantization throughout but future embodiments will make use of more efficient quantization schemes.

The method of this invention then examines the cumulative distribution of wavelet auditory model coefficients and computes the number of coefficients which can be transmitted or stored given the bit allocation and rate, and from these values computes a threshold value $\delta \cdot M$, where M is the maximum coefficient value and $\delta$ is a number between zero and one. For a particular threshold, we only transmit wavelet auditory model coefficients which exceed the value $\delta \cdot M$.

We have established a currently preferred embodiment as an algorithm in a computer program in the C language which operates on digitized acoustic signals, typically voice signals, from the TIMIT library. A listing of the C program is contained in Microfiche Appendix A.

Figure 2A:
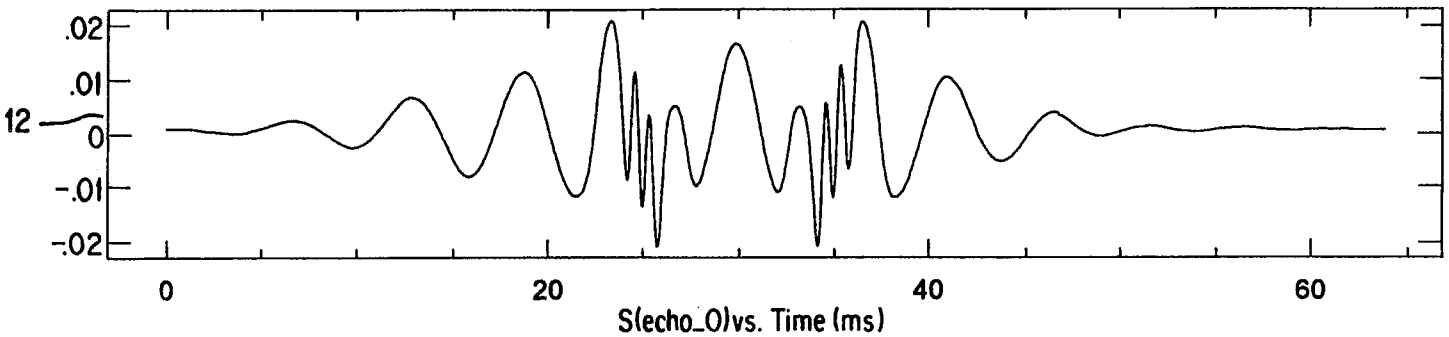
FIG. 2 shows an original frequency modulated signal with an echo, the wavelet auditory model coefficients with the system tuned for data compression, and the reconstructed signal.
Figure 2B:
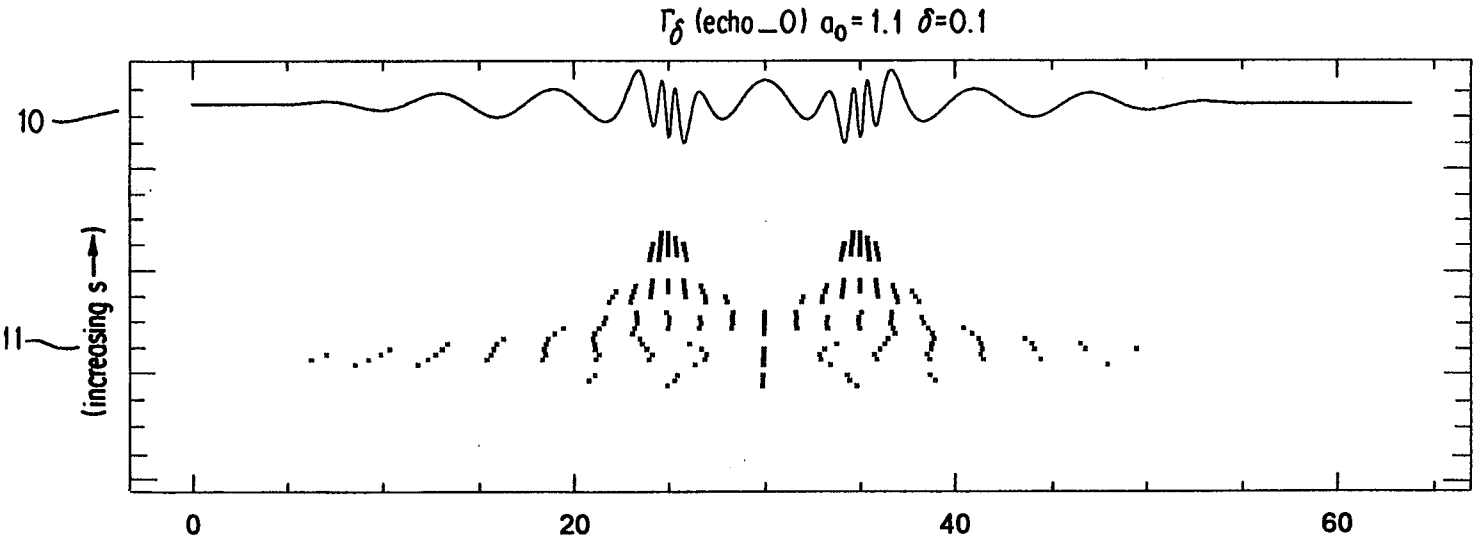
Figure 3A:
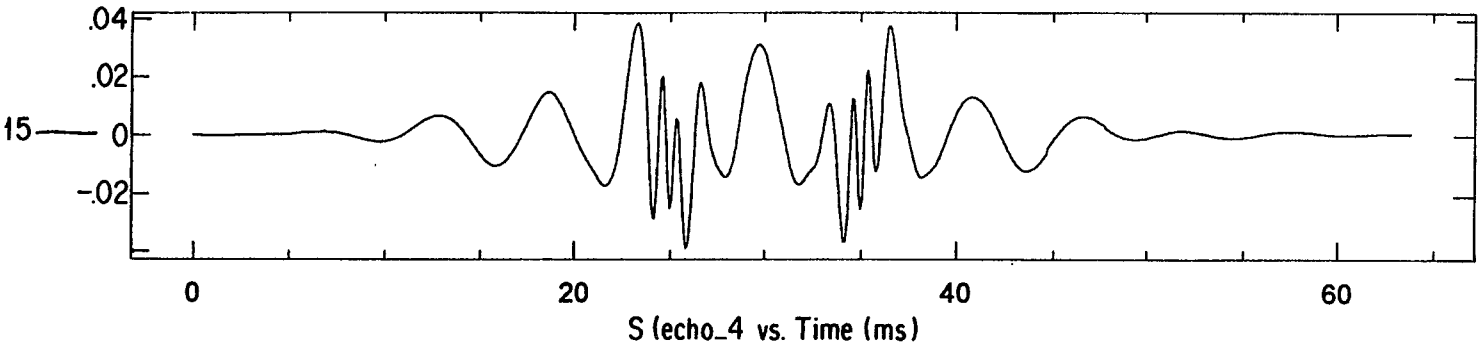
FIG. 3 shows the same input signal with random noise superimposed, the wavelet auditory model coefficients with the system tuned for noise suppression, and the reconstructed signal.
Figure 3B:
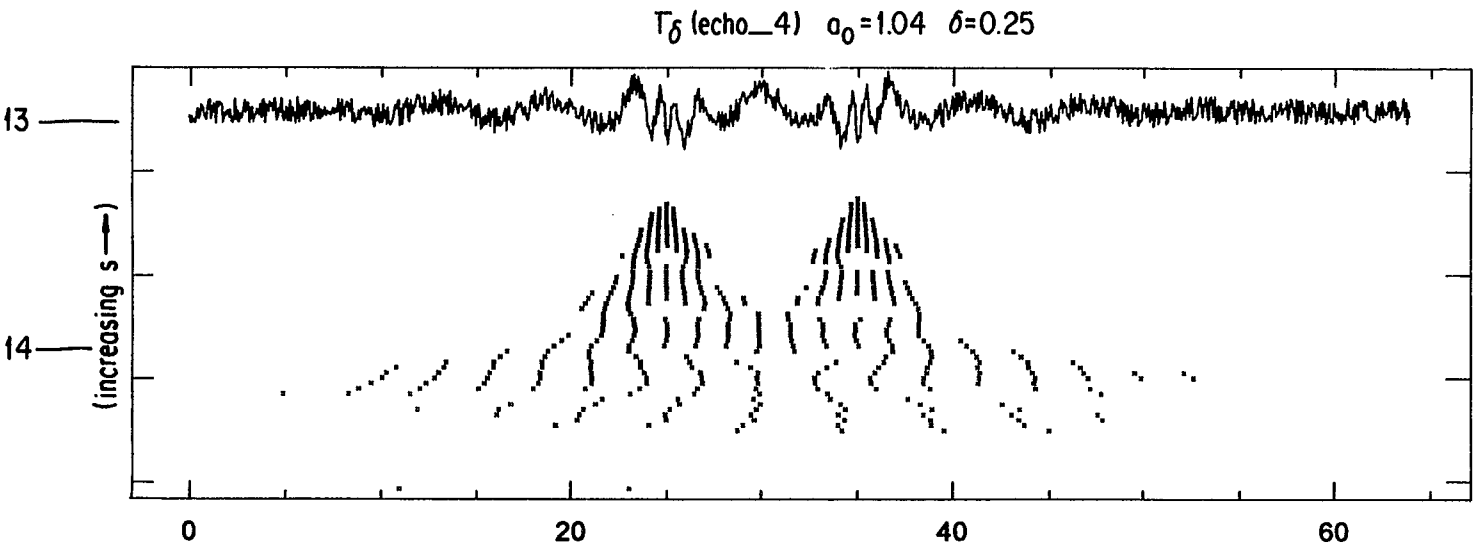
Figure 4A:
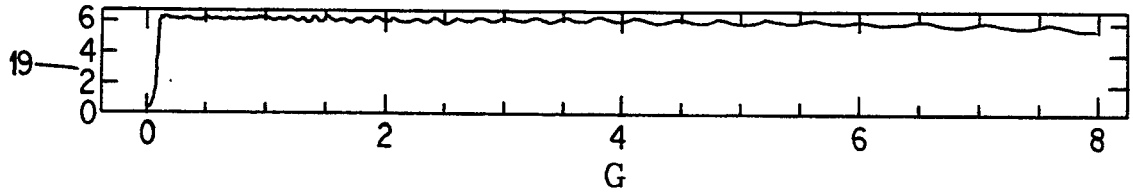
FIG. 4 shows a graph of the original acoustic signal of the "cuckoo" and chime sound from a cuckoo clock, the wavelet auditory model coefficient representation of that sound, and the reconstructed signal.
Figure 4B:
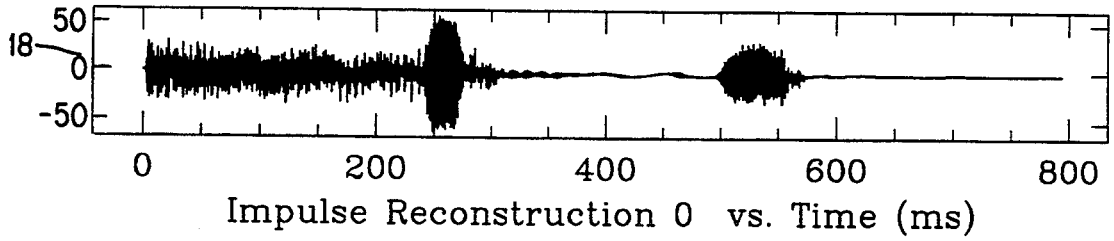
Figure 4C:
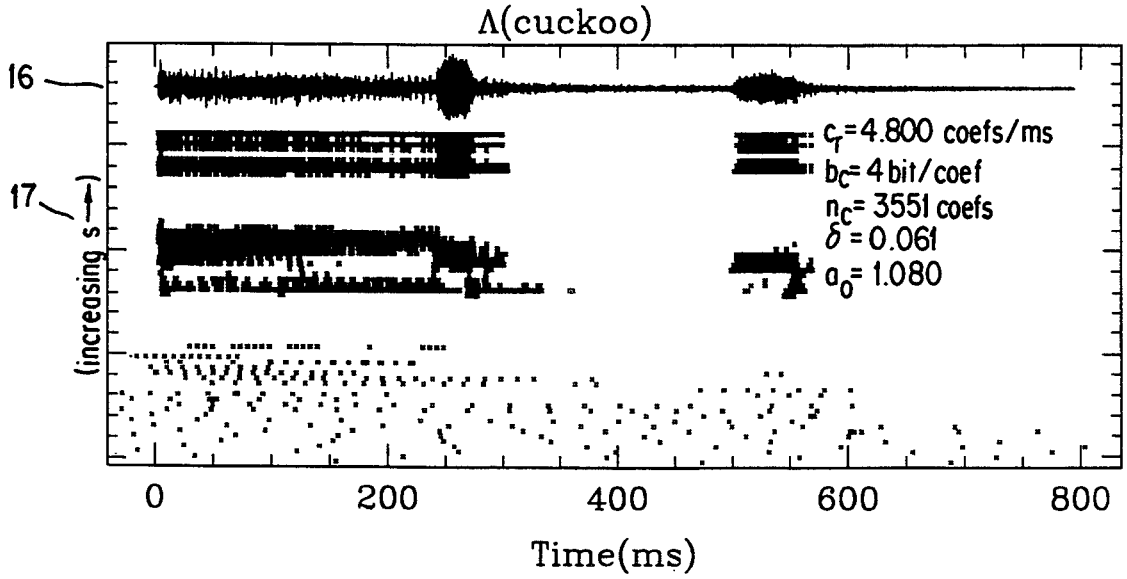
Figure 5:
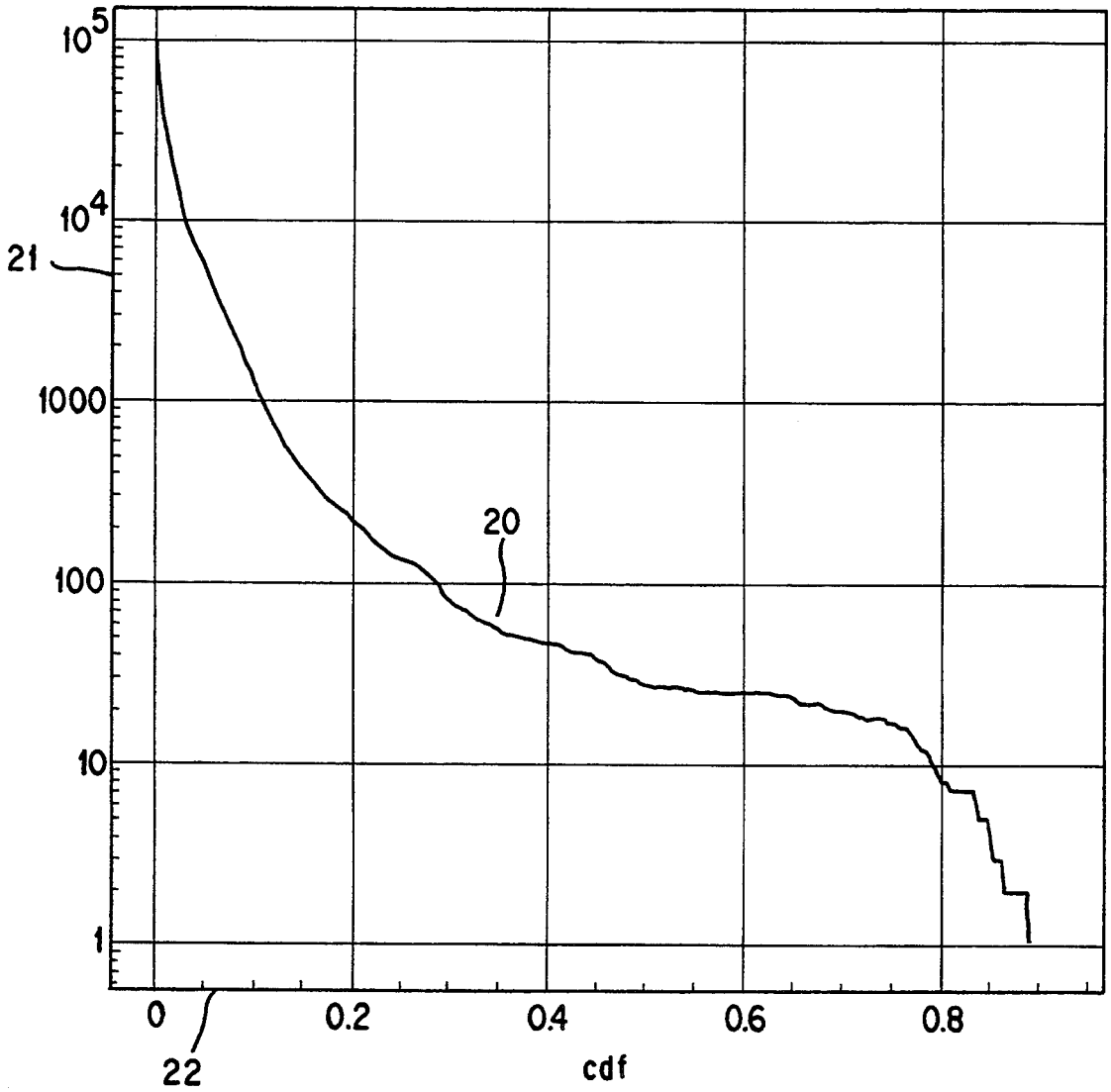
FIG. 5 is a cumulative distribution of wavelet auditory model coefficients for the cuckoo clock and chime sound illustrating the process of thresholding.
Figure 6A:
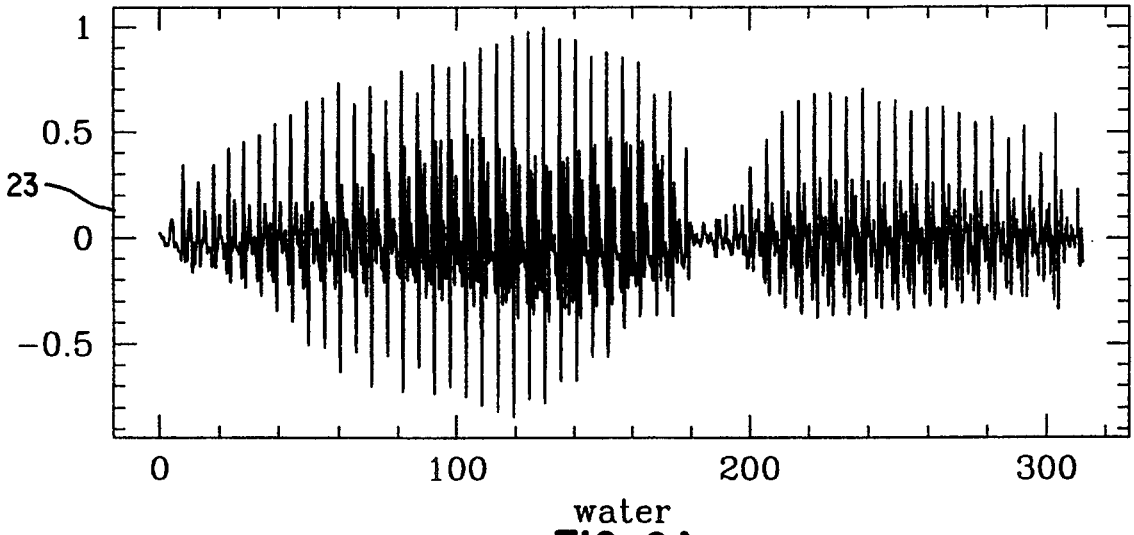
FIG. 6 shows a time domain original signal and reconstructed signal for an acoustic signal of a female saying the word "water."
Figure 6B:
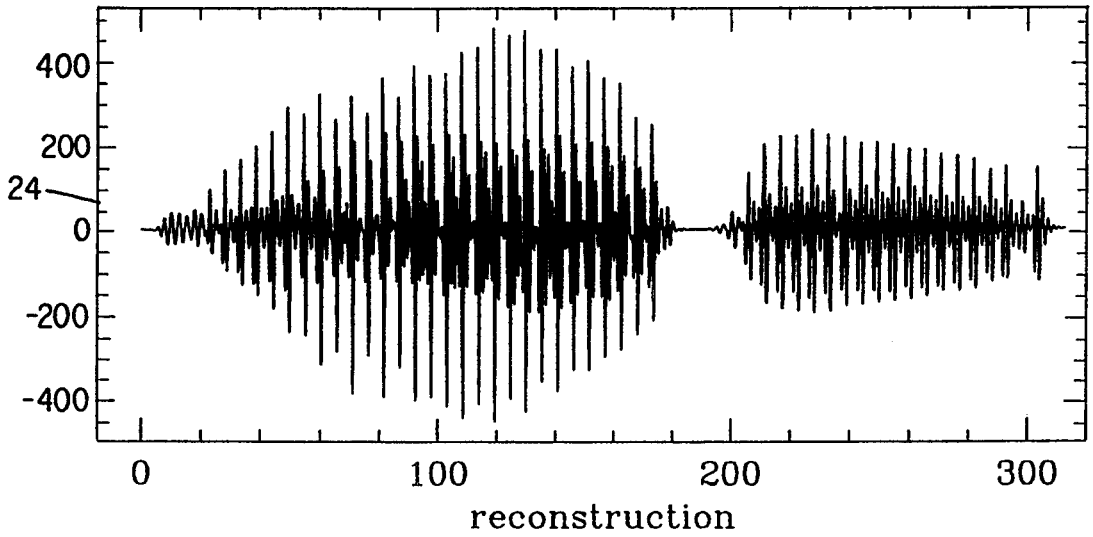
Figure 7:
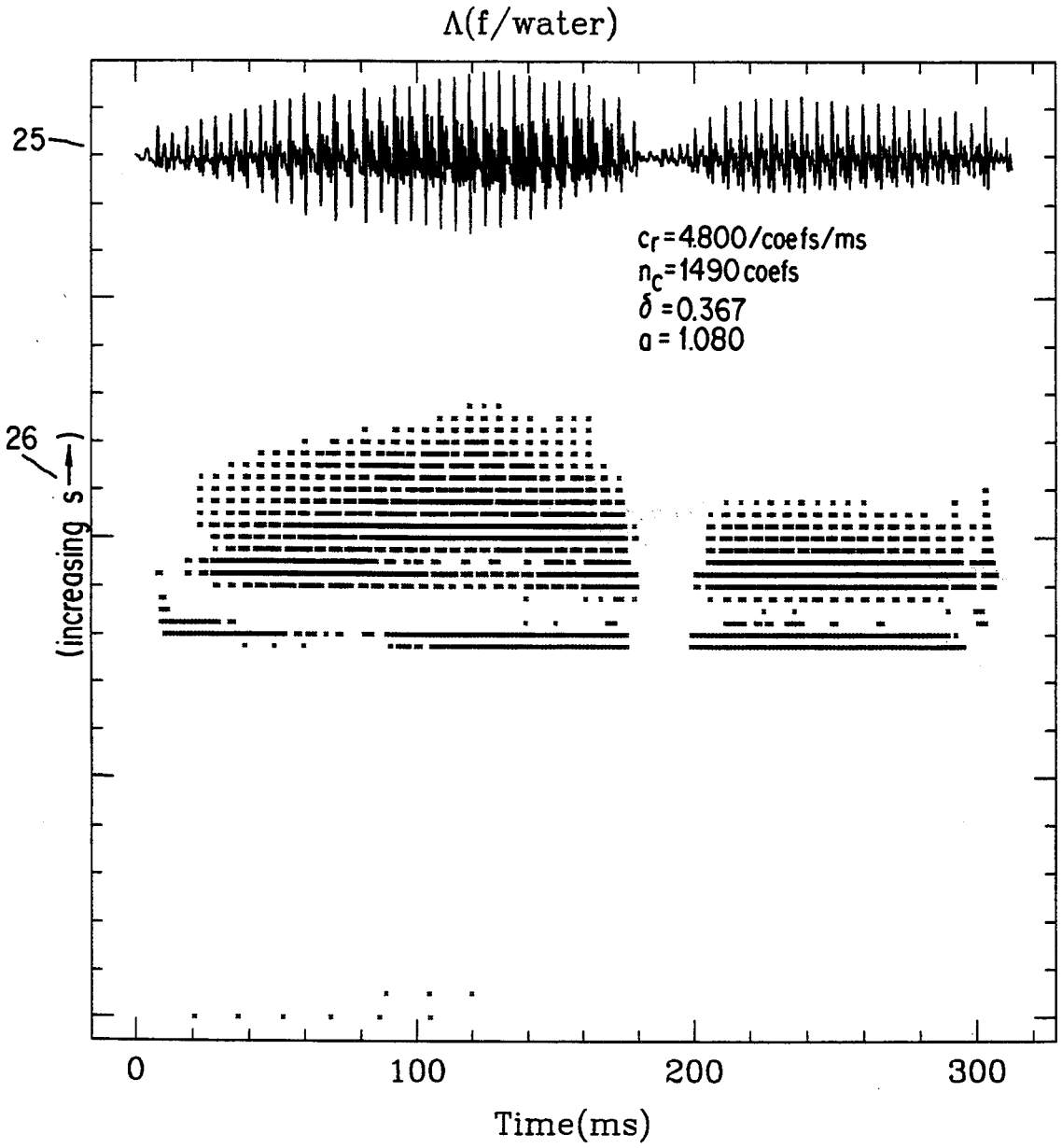
FIG. 7 shows the acoustic signal of a female saying "water" with the thresholded wavelet auditory model representation.
Figure 8:
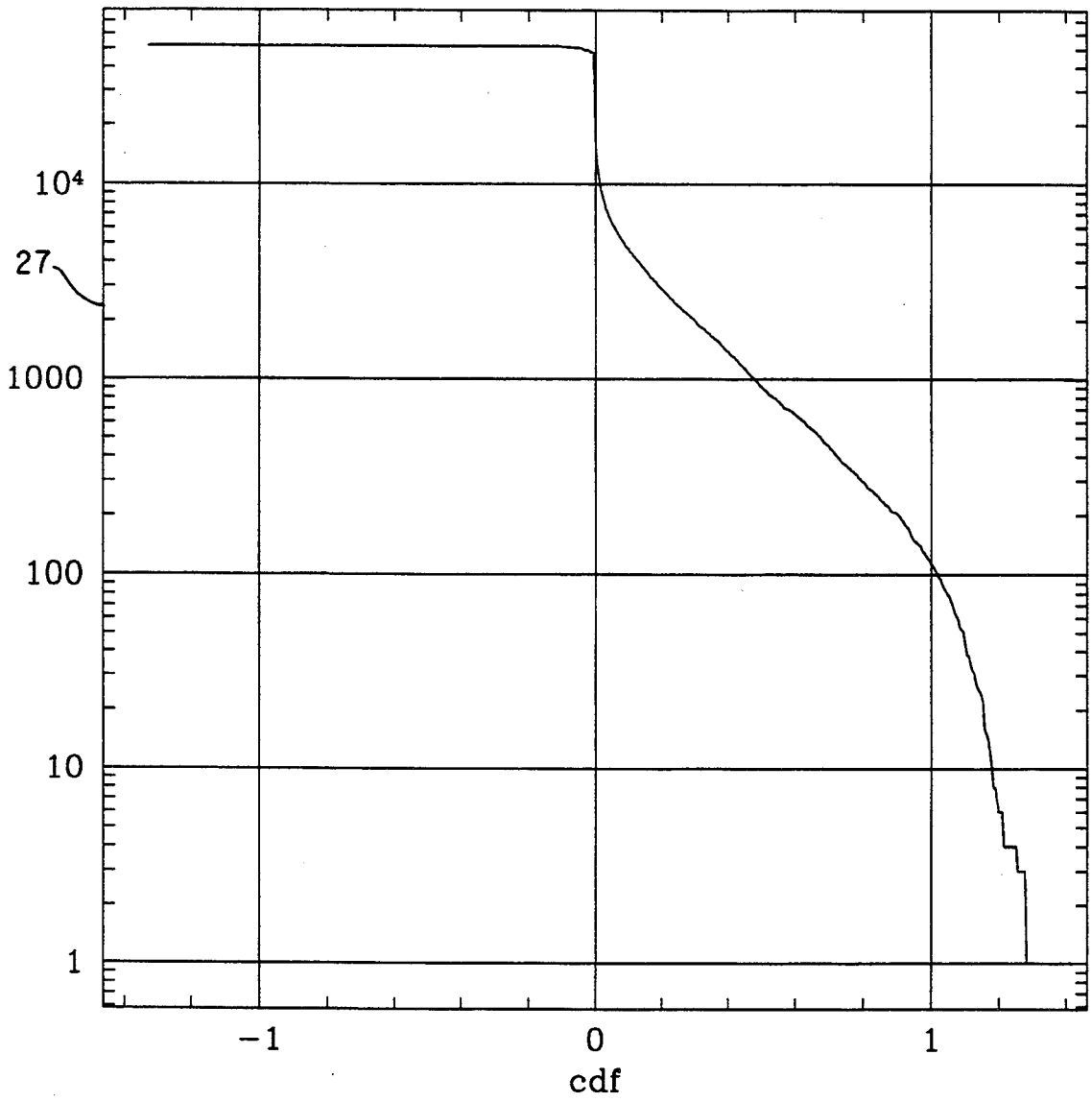
FIG. 8 shows a cumulative distribution of the wavelet coefficients for the word "water" showing thresholding.
Figure 9A:
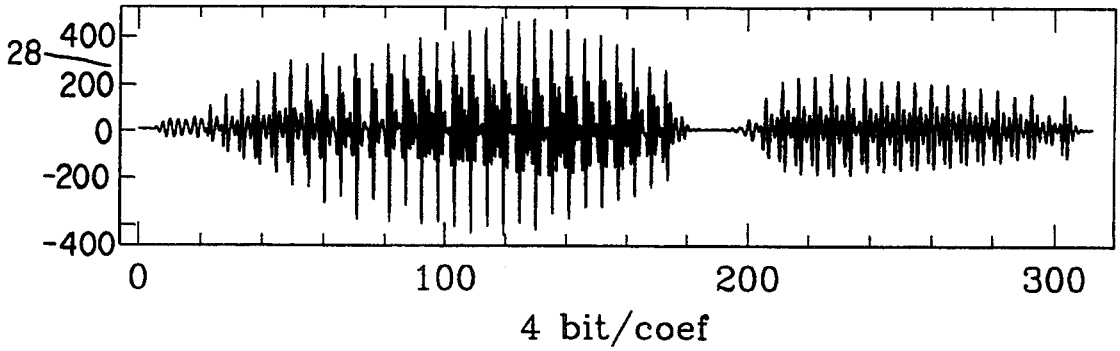
FIG. 9 shows the effect of varying transmission bit rate on the time domain reconstruction of the word "water."
Figure 9B:
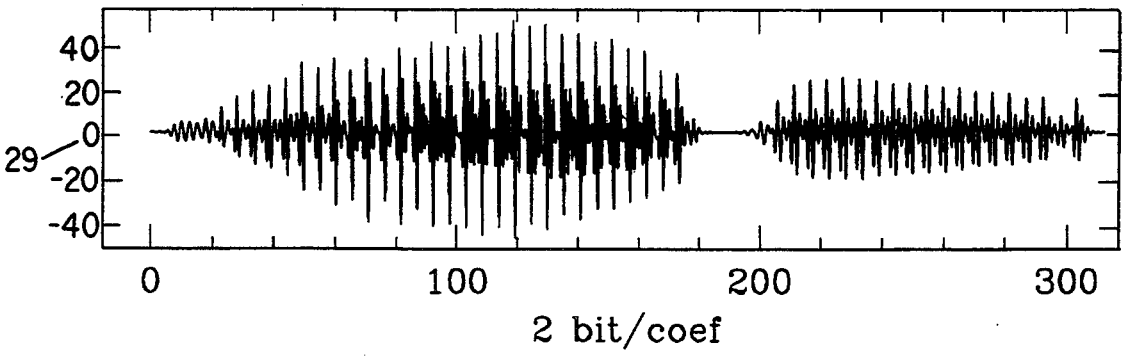
Figure 9C:
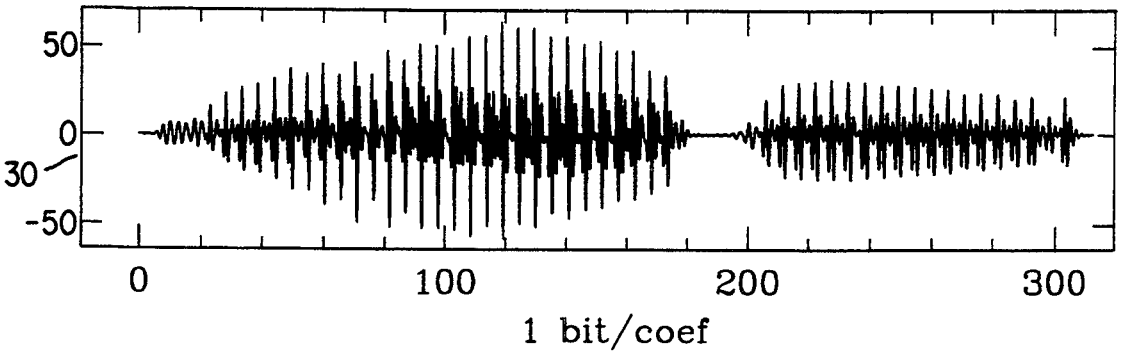
Figure 10A:
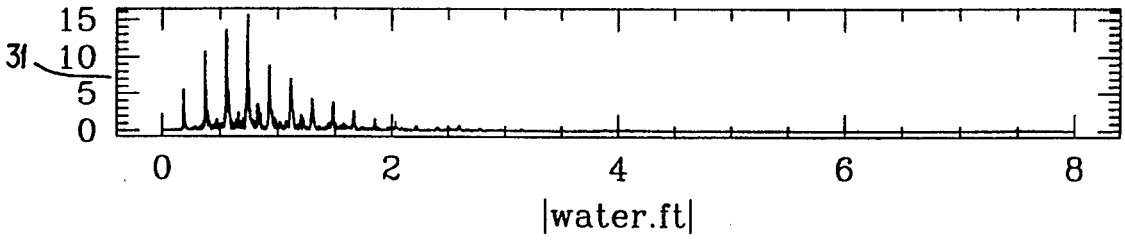
FIG. 10 shows the same reconstructions in the frequency domain compared to the original signal for varying transmission bit rates.
Figure 10B:
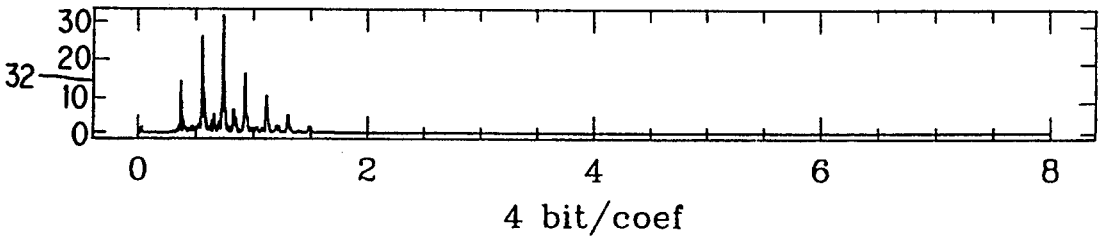
Figure 10C:
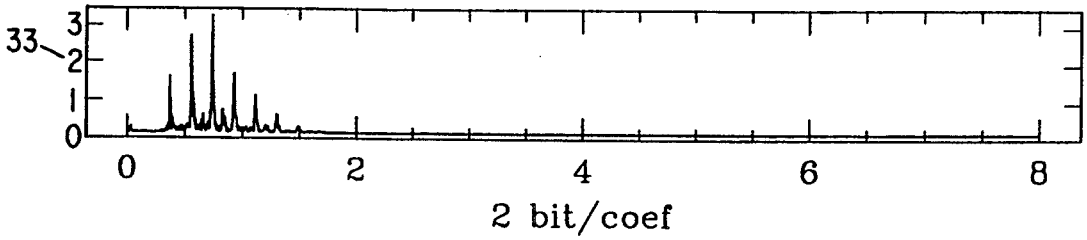
Figure 10D:
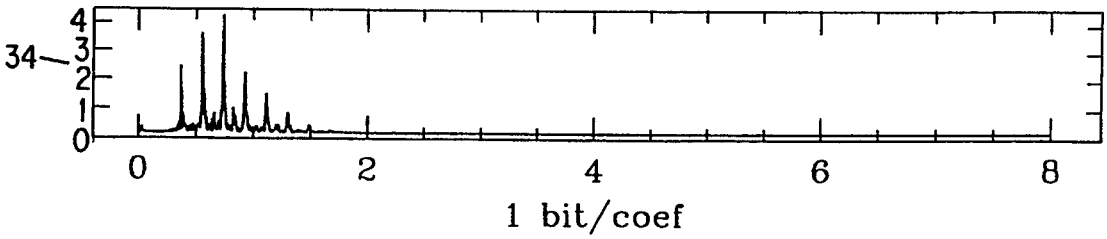

We have processed and reconstructed digital representations of voice and other signals, in particular word signals from the TIMIT voice signals library, using the method of this invention to achieve bit rates as low as 2400 bits per second with high quality reconstruction. The performance of the method is demonstrated in the figures. With reference to FIGS. 2A and 2B, an initial signal which comprises a frequency modulated signal with an echo 10 is processed to produce a truncated set of wavelet auditory model coefficients 11. The reconstructed signal 12 obtained from the irregular sampling method is a good replica of the original. Similarly, in FIGS. 3A and 3B, the input signal 13 has substantial noise superimposed on the frequency modulated wave with echo. Reconstruction from a somewhat less truncated set of wavelet auditory model coefficients 14 produces a very good quality reproduction 15 which substantially eliminates noise. With reference to FIGS. 4A, 4B, and 4C, the original sound of a cuckoo clock preceded by a chime 16 produces the wavelet auditory model representation 17. The reconstruction 18 after substantial compression can be seen visually to be a high quality reproduction and listening to a recorded playback of the reconstructed sound demonstrates subjectively that the reconstruction is of good quality. The function G, 19, shows empirically that the representation is a local frame for irregular sampling reconstruction of the signal. In FIG. 5, the distribution of coefficients 20 permits truncation in which the desired coefficient rate 21 produces the necessary truncation parameter 22. FIGS. 6A and 6B show the original signal for a human female saying "water" 23 and the reconstructed signal 24 at a transmission bit rate of 4800 bits per second. FIG. 7 shows the original signal for "water" and the thresholded wavelet auditory model representation 26. FIG. 8 shows the coefficient distribution 27 for this word from which the necessary truncation parameter can be determined. FIGS. 9A, 9B, and 9C show the effect of varying one factor which comprises part of the bit rate, namely the quantization bit density of the coefficient quantization. The reconstructed signal is shown respectively at 4 bits per coefficient 28, 2 bits per coefficient 29, and 1 bit per coefficient 30. Correspondingly, FIGS. 10A, 10B, 10C, and 10D show the frequency domain representation of the incoming signal 31 and the reconstruction respectively at 4 bits per coefficient 32, 2 bits per coefficient 33, and 1 bit per coefficient 34. Clearly some definition is lost as the quantization becomes coarser, but listening proves the reconstructed signal subjectively intelligible even at 1 bit per coefficient.

Additional Embodiments

Various segments of wavelet auditory model can be embedded in hardware. Such hardware embodiments will enhance performance and speed of coding and decoding. In one alternative embodiment, an analog acoustic pressure wave enters a transducer, the output of which is an analog electric signal representing the acoustic signal. The coding filter bank comprises a plurality of filter channels on a dedicated Very Large Scale Integration (VLSI) chip. Each channel performs filtering by means of a filter transfer function the amplitude of which is a smoothed ramp function with tails sufficient for causality. The filter transform functions of the individual channels on the VLSI are related according to the wavelet dilation relationship, Equation (1). Each filter, a separate channel, produces an analog output signal. At this point, the analog signal would ordinarily be digitized for quantizing, truncation, and transmission.

Alternatively, the filter bank can comprise a plurality of VLSI's which operate on a digitized or inherently digital incoming signal and perform the filter function digitally. In another alternative embodiment, the filter bank can comprise a plurality of preprogrammed dedicated signal chips which operate on digitized signals to perform the filter function. In these embodiments separate digitizers in the output of each channel are not necessary. Further, the quantization and truncation functions can be embedded in VLSI or in dedicated signal processing chips.

At the receiving end or the reconstruction point, a VLSI or a plurality of dedicated signal processing chips performs the reconstruction algorithm by means of an inverse filter bank comprising inverse filter channels embedded in VLSI or in a plurality of dedicated signal chips. If the desired output is digital, the elements comprising the filter bank can be entirely digital. If the required output is analog, digital to analog conversion can be performed in the filter bank. If the filter bank is implemented in digital VLSI or in dedicated signal processing chips, digital to analog conversion occurs at the output side of the inverse filter bank.

Figure 11:
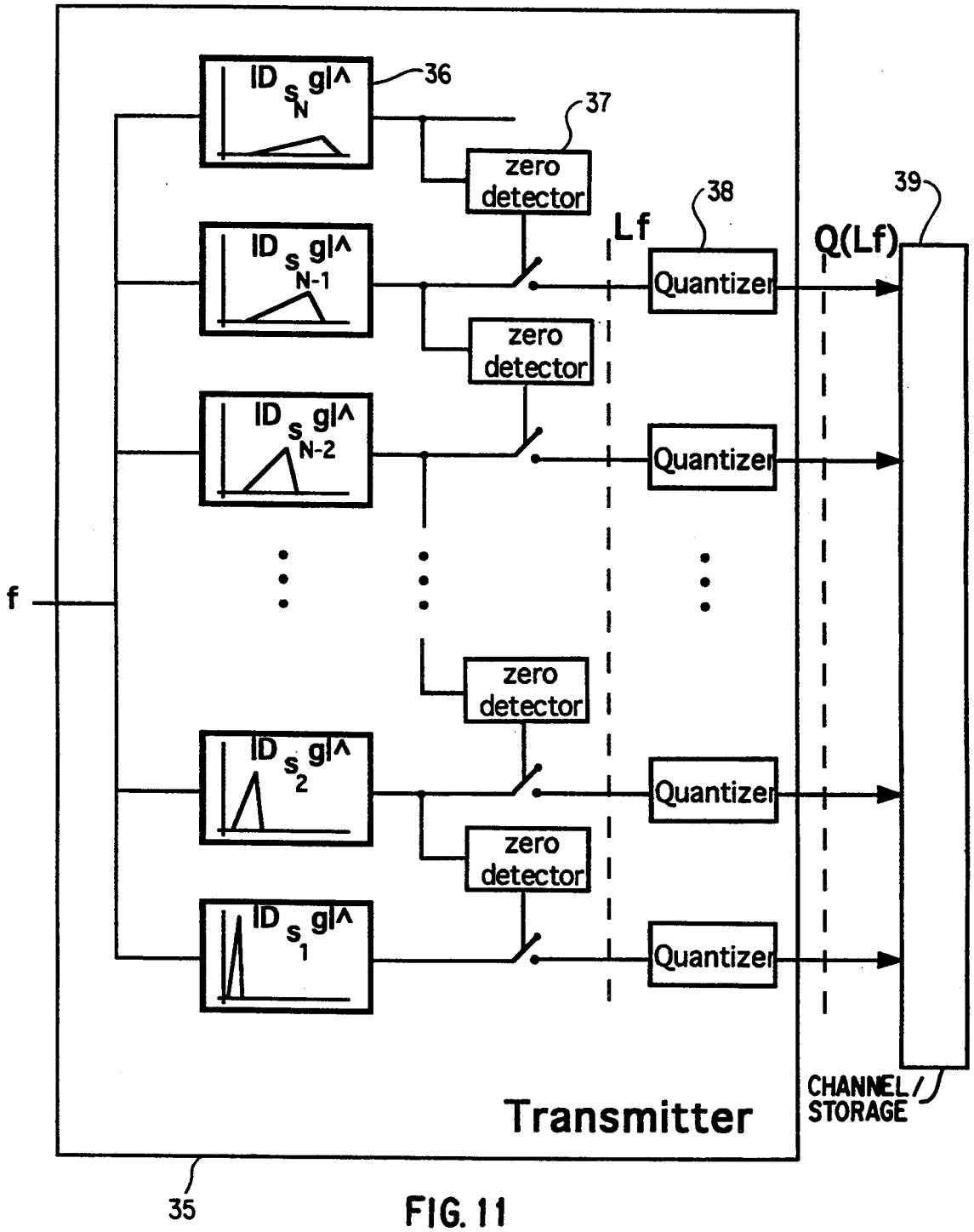
FIGS. 11 through 14 are schematic diagrams illustrating apparatus comprising conventional components specifically adapted to perform the method disclosed herein.

In FIG. 11, a VLSI or a plurality of signal processing chips 35 containing the various processing elements comprises the wavelet coefficient apparatus at the transmitting end of the wavelet auditory model system. Each filter channel 36 is either an element on the VLSI or is contained in a signal processing chip; the filter 36 has its output tapped by an element 37 which responds at the zeros of the filter output and obtains a sample from the next lower channel. This output is then fed to a quantizer element 38 either on the VLSI or in signal processing chip, which in turn sends its output to a multichannel transmission or storage medium 39 which also contains truncation apparatus.

Figure 12:
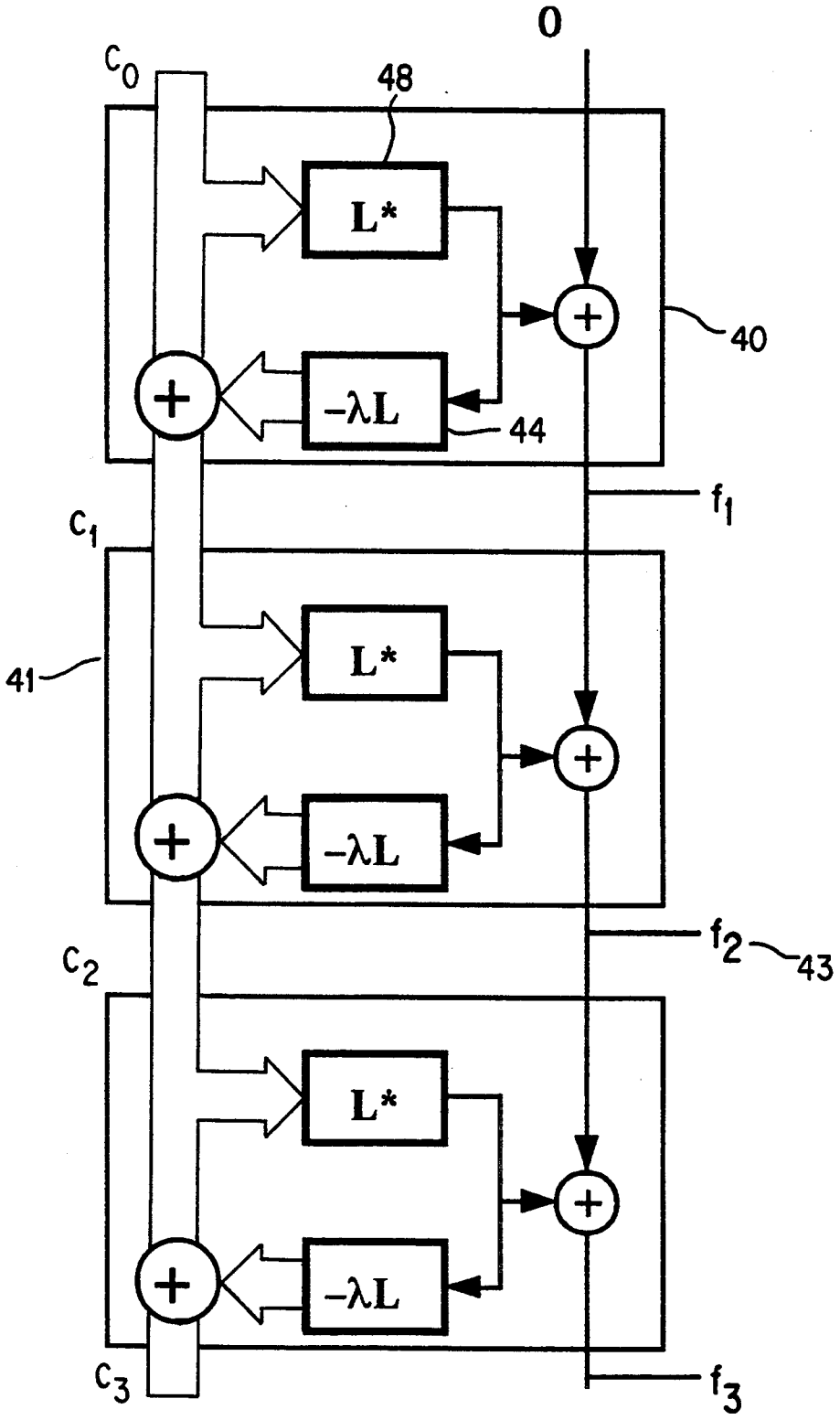

FIG. 12 demonstrates the overall arrangement of the decoding apparatus 40, a cascade of processing units, which also is embedded in VLSI or in a plurality of signal processing chips. Each element 41 of the cascade represents one "iteration" of the wavelet auditory model decoding process. The top element receives the truncated set of wavelet auditory model coefficients and processes them through one step of the process 48. At any level, e.g., the second level, the output signal $f_2$, 43, can be tapped off for final output or alternatively sent to a reanalyzer element 44 which produces a second set of multichannel outputs which are in turn fed to the second decoding element 41 to create a second iteration of the decoded signal $f_2$, 43.

Figure 13:
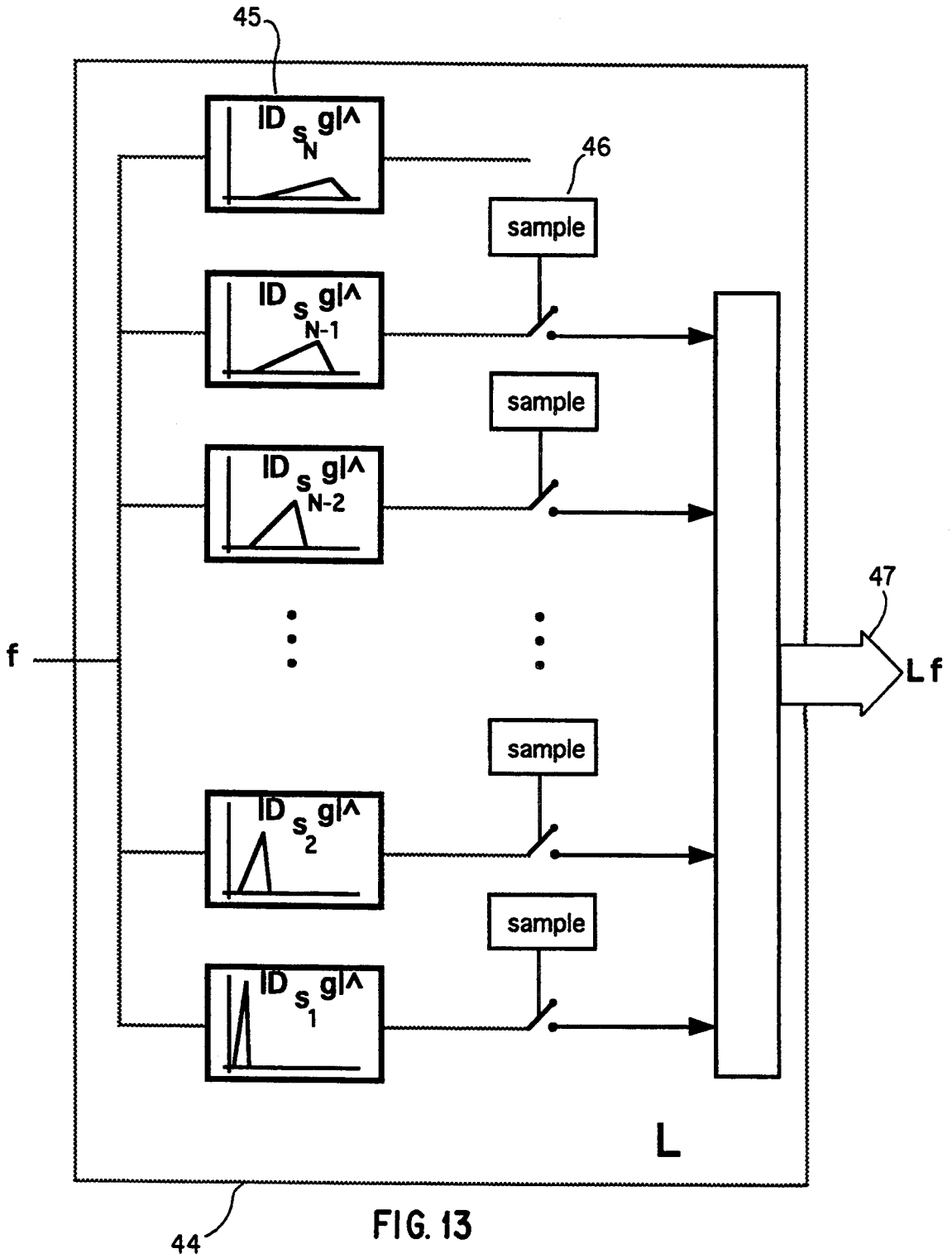

FIG. 13 shows a further breakdown of the reanalyzer element 44, showing the individual channel inverse filter elements, again part of a VLSI or all or part of a signal processing chip. The resampling element 46 is necessary for input into the second iteration of the decoding algorithm 41. The output 47 of the reanalyzer element 44 is a multichannel output which feeds into the second decoding element 41.

Figure 14:
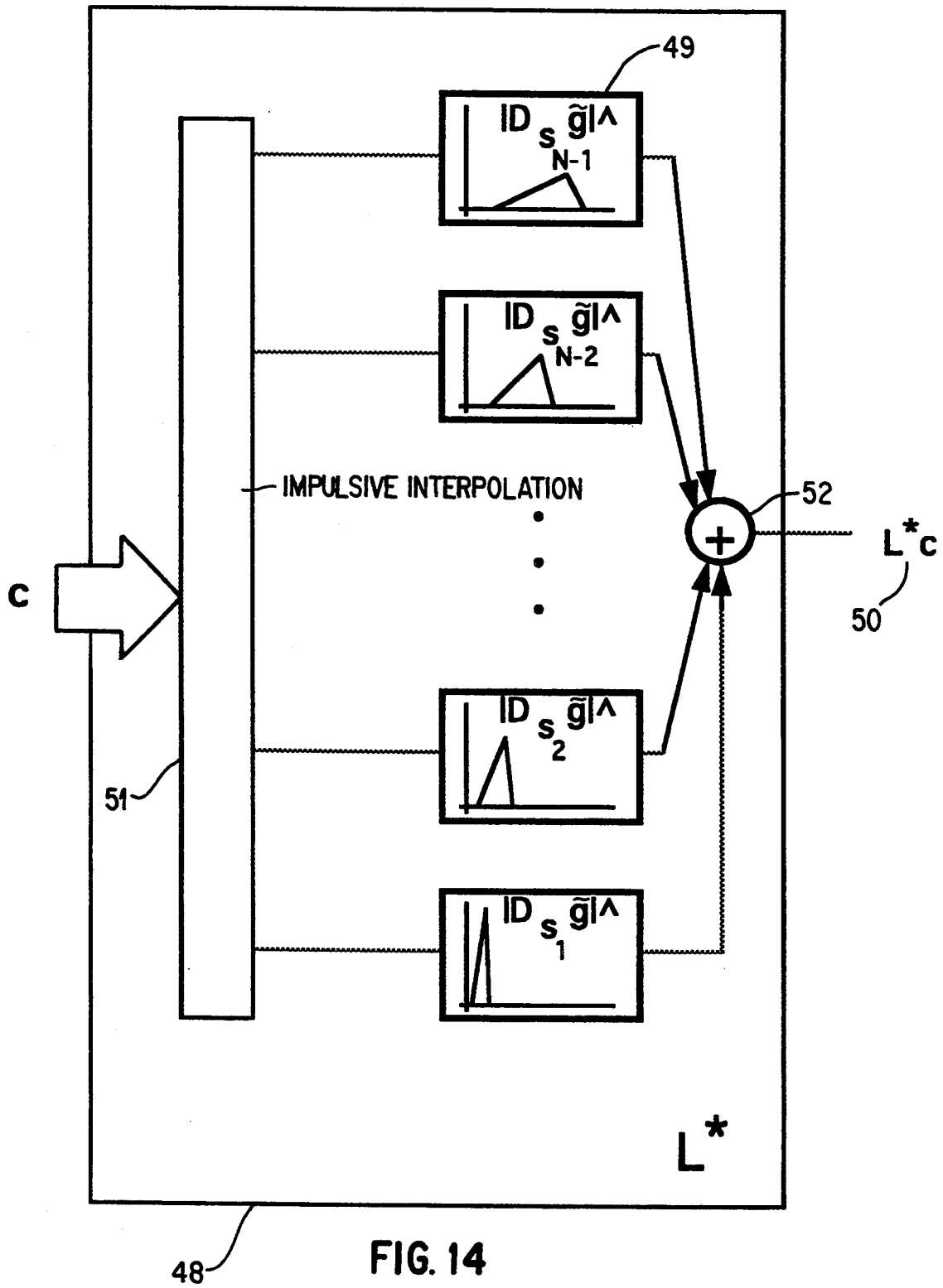

FIG. 14 illustrates the individual decoding elements 48 which comprise the L* portion of the decoding cascade 40. The multichannel input from the previous stage or the transmission line feeds into an impulsive interpolation element 51, which in turn feeds each channel to a corresponding inverse filter element 49. Each of these sends its output to an adder element 52, which sums the individual channels and outputs the composite signal 50 corresponding to L*c, which then either becomes the final output or is reanalyzed and sent to the next stage of the cascade 40. At an appropriate stage of the cascade according to the particular application the output signal, $f_1$, $f_2$, $f_3$, or $f_4$, etc., is sent to a conventional means for converting an electric signal into an audible acoustic signal.

We anticipate that improvements in the method alone or in combination with use of hardware devices will improve the performance of wavelet auditory model sufficiently for real time application. In addition, other hardware devices in addition to VLSI implementation may become available to perform the functions described herein.

We have tested wavelet auditory model primarily for speech processing, but other audible signals have been successfully processed as well. Moreover, additional applications will become apparent to those skilled in the arts of signal processing and signal coding.

We claim:

1. A method of encoding acoustic signals for data compression and noise suppression comprising the steps of:

(1) utilizing a bank of acoustic filters modeled on the mechanical characteristics of the mammalian cochlea such that the amplitude of the frequency response of the filter in the frequency domain is a smoothed ramp function, also generically referred to as a "shark fin" shape, with tails that guarantee that the acoustic filter is causal because the filter transform function satisfies the Hilbert transform relationships, said filters being established by the substeps comprising:

(a) establishing the basic filter function by taking the convolution of a linear ramp filter transfer function frequency response amplitude in the frequency domain with a second function, said ramp function comprising a straight line sloping from zero amplitude at a lower cutoff frequency upward to an upper amplitude at a higher cutoff frequency and having a zero amplitude outside the frequency range from the lower cutoff frequency to the higher cutoff frequency, said second function being a very narrow symmetric single peak distribution so as to produce a ramp function frequency response amplitude with smooth corners such that the response amplitude varies smoothly throughout its frequency range;

(b) piecing smooth small amplitude frequency response tails to the said convolution below a second lower cutoff frequency and above a second higher cutoff frequency in such a manner that the frequency response amplitude is continuous and has a defined logarithm for all frequencies and satisfies the Paley-Wiener logarithmic integral condition so that a frequency response phase angle can be ascertained for all frequencies using the Hilbert transform relations, whereby it is assured that the filter is causal; and (c) using the fundamental wavelet relationship to construct a filter bank comprising a plurality of filter impulse responses for a plurality of scales from said basic filter function by scaling said basic filter function according to the wavelet transform relationship, each scale corresponding to a fundamental frequency of a scaled filter, and the entire plurality of scaled filters comprising the filter bank;

(2) transforming a finite duration electric signal representing an acoustic signal into a wavelet representation in time and scale of said electric signal by processing the electric signal through the scaled filters in the filter bank; and (3) obtaining the wavelet coefficients $$\Lambda_w(f) = \left\{ \frac{W_{\frac{\partial g}{\partial t}} f(t_{m,n}, S_{m-1})}{\sqrt{1 - a_0}} \right\}$$

at the zero crossings of the time derivative of the wavelet transform; and (4) truncating the set of wavelet coefficients according to the data capacity and rate of the system to which the coefficients are sent.

2. A method of signal compression and noise suppression for acoustic signals comprising the steps of:

(1) coding the electrical representation of an acoustic signal using the substeps:

(a) utilizing a bank of acoustic filters modeled on the mechanical characteristics of the mammalian cochlea such that the amplitude of the frequency response of the filter in the frequency domain is a smoothed ramp function, also generically referred to as a "shark fin" shape, with tails that guarantee that the acoustic filter is causal because the filter transform function satisfies the Hilbert transform relationships, said filters being established by the substeps comprising:

(i) establishing the basic filter function by taking the convolution of a linear ramp filter transfer function frequency response amplitude in the frequency domain with a second function, said ramp function comprising a straight line sloping from zero amplitude at a lower cutoff frequency upward to an upper amplitude at a higher cutoff frequency and having a zero amplitude outside the frequency range from the lower cutoff frequency to the higher cutoff frequency, said second function being a very narrow symmetric single peak distribution so as to produce a ramp function frequency response amplitude with smooth corners such that the response amplitude varies smoothly throughout its frequency range;

(ii) piecing smooth small amplitude frequency response tails to the said convolution below a second lower cutoff frequency and above a second higher cutoff frequency in such a manner that the frequency response amplitude is continuous and has a defined logarithm for all frequencies and satisfies the Paley-Wiener logarithmic integral condition so that a frequency response phase angle can be ascertained for all frequencies using the Hilbert transform relations, whereby it is assured that the filter is causal; and (iii) using the fundamental wavelet relationship to construct a filter bank comprising a plurality of filter impulse responses for a plurality of scales from said basic filter function by scaling said basic filter function according to the wavelet transform relationship, each scale corresponding to a fundamental frequency of a scaled filter, and the entire plurality of scaled filters comprising the filter bank;

(b) transforming a finite duration electric signal representing an acoustic signal into a wavelet representation in time and scale of said electric signal by processing the electric signal through the scaled filters in the filter bank;

(c) obtaining the wavelet coefficients $$\Lambda_w(f) = \left\{ \frac{W_{\frac{\partial g}{\partial t}} f(t_{m,n}, s_{m-1})}{\sqrt{1 - a_0}} \right\}$$

at the zero crossings of the time derivative of the wavelet transform; and (d) truncating the set of wavelet auditory model coefficients according to the data capacity and rate of the system to which the coefficients are sent;

(2) transmitting the truncated set of wavelet auditory model coefficients; and (3) reconstructing the original signal to a predetermined degree of approximation at the receiving end using the substeps:

(a) defining $h_k \equiv \lambda L^* c_k$, $c_{k+1} = c_k - Lh_k = c_k - \lambda LL^* c_k$ and $f_{k+1} \equiv f_k + h_k$;

(b) in the first iteration, setting $f_0 = 0$ and computing $h_0$, $c_0$, and $f_1 = f_0 + h_0$;

(c) performing a number of subsequent iterations predetermined to produce the predetermined degree of approximation, such that at step $k+1$, where $k+1$ is less than the predetermined number of iterations, the iteration computes $h_k$ using $c_k$ from step k, computes $c_{k+1}$ using $h_k$ and $c_k$, and computes $f_{k+1} = f_k + h_k$.

3. A method of processing acoustic signals for controllable levels of signal compression and noise reduction comprising the method of claim 2 plus the additional step of tuning the parameters of the model for either maximum acceptable compression or optimum noise rejection.

4. The methods of claims 2 or 3 wherein the incoming acoustic signal and the reconstructed version of the original signal comprise human speech signals.

5. The methods of claims 2 or 3 wherein the methods are performed off-line to a signal stored for off-line cleanup.

6. An apparatus for reconstructing an electrical representation of an acoustic signal from quantized and truncated output of a wavelet filter bank comprising:

a. a means for performing the reconstruction algorithm: define $h_k \equiv \lambda L^* C_k$, $C_{k+1} = C_k - Lh_k = C_k - \lambda LL^* C_k$ and $f_{k+1} \equiv f_k + h_k$; in the first step set $f_o = 0$ and compute $h_o$, $c_o$, and $f_1 = f_o + h_o$; at step $k+1$, compute $h_k$ using $c_k$ from step n, compute $c_{k+1}$ using $h_k$ and $c_k$, and compute $f_{k+1} = f_k + h_k$;

b. an inverse filter bank for producing an output electrical signal from the output of the reconstruction algorithm.

7. The apparatus of claim 6 wherein the individual filters, quantizers, and truncators are embedded in devices selected from the group comprising VLSI's and dedicated preprogrammed signal chips.

8. A wavelet auditory model apparatus for encoding, transmitting, and decoding electrical representations of acoustic signals comprising:

a. A means for accepting an incoming electric signal representing an acoustic signal;

b. a filter bank operating on said electric signal comprising a plurality of filters, each filter having a filter response function amplitude which is a smoothed ramp function with tails assuring causality, and a phase satisfying the Hilbert Transform relation, said filter response functions being related to one another by the wavelet dilation relationship, and each filter being contained in a channel;

c. means for output of the filtered result of each channel;

d. means for quantizing and truncating the output of the filters for transmission according to the capacity and data rate of the transmission channel;

e. means for transmitting or storing said quantized and truncated output of said filters;

f. means for reconstructing an electrical representation of an acoustic signal from quantized and truncated output of a wavelet filter bank, said means comprising a cascaded plurality of reconstruction elements, each element comprising:

(1) an inverse filter bank comprising a plurality of filter channels performing one step of the reconstruction algorithm $f_{k+1}=f_k+h_k$, where $h_k \equiv \lambda L^* C_k$, $C_{k+1}=C_k-Lh_k=C_k-\lambda LL^* C_k$ and $f_{k+1} \equiv f_k+h_k$, namely, compute $h_k$ using $c_k$ from step n, compute $c_{k+1}$ using $h_k$ and $c_k$, and compute $f_{k+1}=f_k+h_k$, in which each filter channel performs the operation $\lambda L^* c_k$;

(2) a means for summing the output of the inverse filter channels into a composite signal;

(3) a means for tapping the output signal for potential output;

(4) a forward filter bank which receives the composite signal from the inverse filter channels and reanalyzes said composite signal and inputs it into the next stage of inverse filter bank cascade;

(5) a means for transmitting the output of the final stage inverse filter bank as the output reconstructed signal.

* * * * *